United States Patent [19]

McCarthy

[11] Patent Number: 4,923,419

[45] Date of Patent: May 8, 1990

[54] POSITIVE DRIVE SWIM FIN

[76] Inventor: Kevin I. McCarthy, 6841 Via Verano, Carlsbad, Calif. 92008

[21] Appl. No.: 180,544

[22] Filed: Apr. 12, 1988

Related U.S. Application Data

[63] Continuation-in-part of Ser. No. 913,240, Sep. 30, 1986, abandoned.

[51] Int. Cl.[5] ..... A63B 31/11

[52] U.S. Cl. ..... 441/64

[58] Field of Search ..... 441/64

[56] References Cited

U.S. PATENT DOCUMENTS

| | | | |
|---|---|---|---|
| D. 124,013 | 12/1940 | Churchill | D21/239 |
| D. 132,377 | 5/1942 | Smith | 441/64 |
| 1,674,801 | 6/1928 | Schwalge | 441/64 |
| 2,321,004 | 6/1943 | Churchill | 441/64 |
| 2,423,571 | 7/1947 | Wilen | 441/64 |
| 2,588,363 | 3/1952 | De Corlieu | 441/64 |
| 2,865,033 | 12/1958 | Jayet | 441/64 |
| 4,521,220 | 6/1985 | Schoofs | 441/64 |
| 4,787,871 | 11/1988 | Tomlinson | 441/64 |

FOREIGN PATENT DOCUMENTS

| | | | |
|---|---|---|---|
| 997264 | 1/1952 | France | 441/64 |
| 1351417 | 12/1963 | France | 441/64 |
| 1510558 | 1/1968 | France | 441/64 |
| 2389386 | 1/1979 | France | 441/64 |

*Primary Examiner*—Sherman D. Basinger
*Assistant Examiner*—Stephen P. Avila
*Attorney, Agent, or Firm*—George F. Bethel; Patience K. Bethel

[57] ABSTRACT

The specification herein shows a swimmer's fin having a foot pocket and a blade portion wherein the blade portion is offset from the foot pocket to compensate for the natural supination during a flutter kick, stroke or beat, regardless of whether or not it is a backstroke, kick, or a crawl stroke kick. The fin can be molded in a symmetrical manner so that it can be interchanged between the feet and provided with an offset ankle strap in order to create a more comfortable relationship during the swimming movement. The fin also includes an improved blade end having inner and outer curves wherein the outer curve from the body is of a larger radius than the inner curve. The offset of the foot pocket from the blade can be such wherein the axis of the blade and the axis of the foot pocket intersect within the foot pocket area to provide for improved performance.

29 Claims, 6 Drawing Sheets

FIG. 16
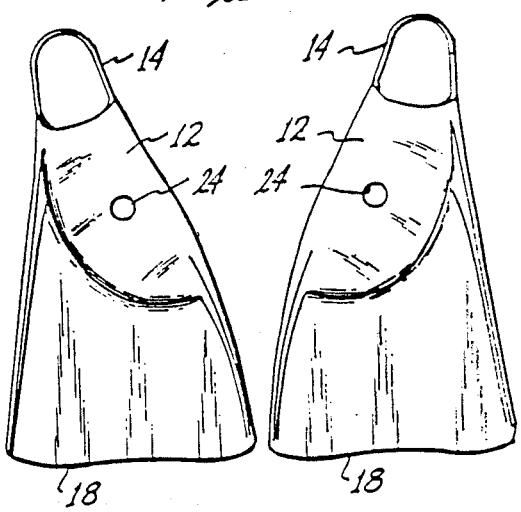
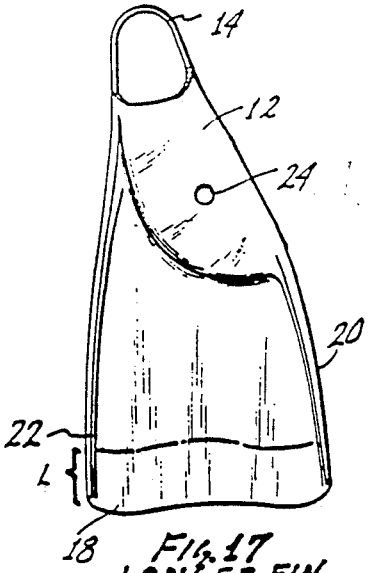
FIG. 17
LONGER FIN
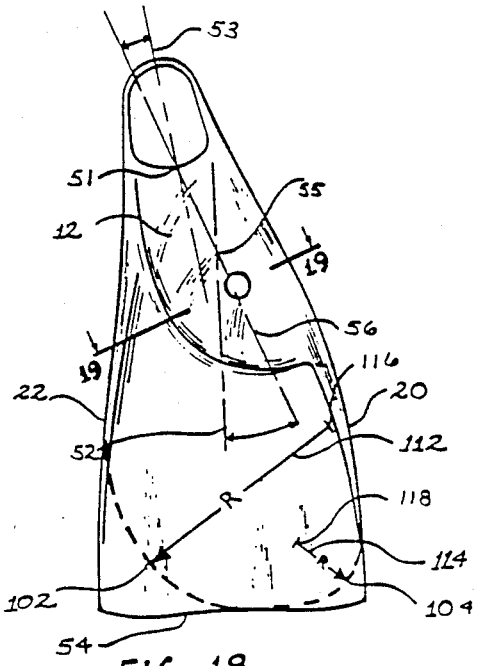
FIG. 18
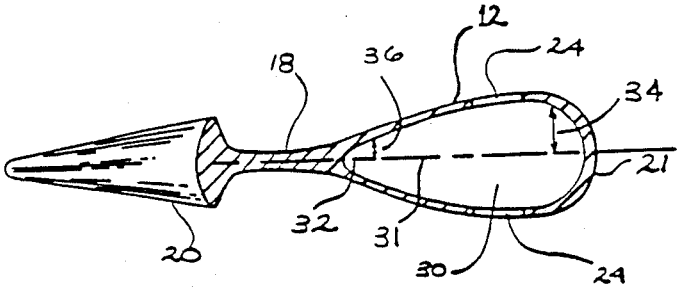
FIG. 19

FIG. 20
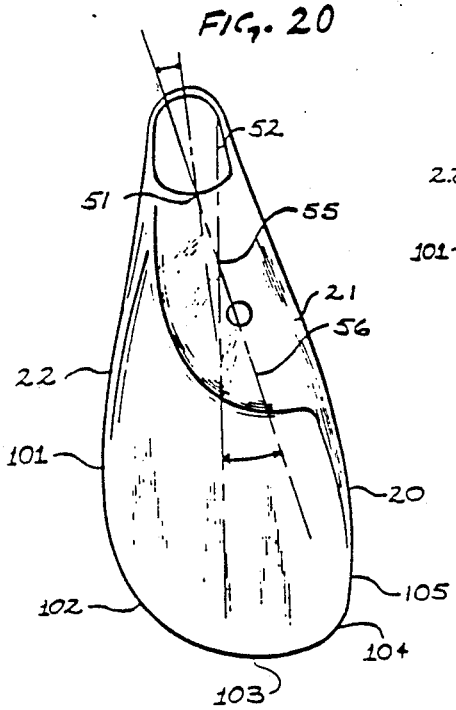
FIG. 21
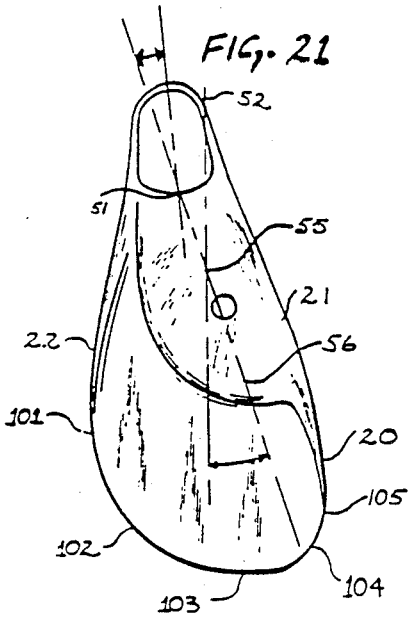
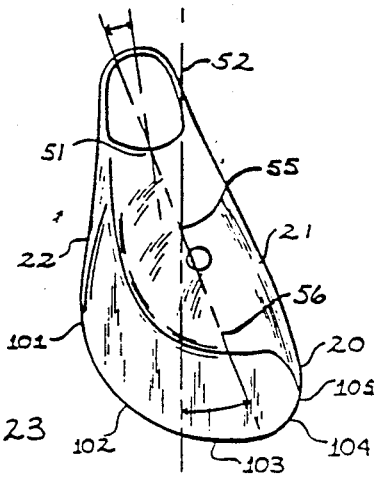
FIG. 22
FIG. 25
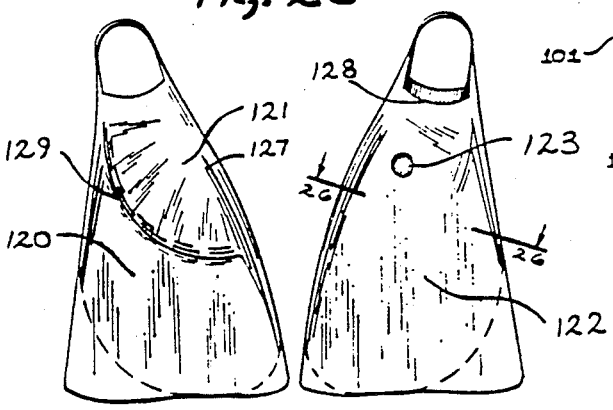
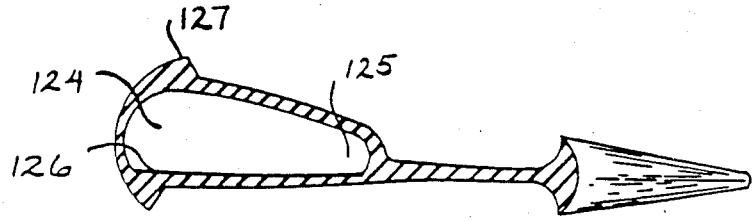
FIG. 26

POSITIVE DRIVE SWIM FIN

This application is a continuation-in-part of prior application entitled Positive Drive Swim Fin, naming KEVIN I. MC CARTHY as inventor, bearing Ser. No. 06/913,240 and filed on Sept. 30, 1986 now abandoned.

FIELD OF THE INVENTION

This invention relates to swimming with a swim fin which can be caused by scuba divers as well as those free divers and other people who use swim fins. More particularly, it relies upon the overall aspects of providing a proper orientation to the drive portion of a swim fin due to the natural supination that takes place by the foot during the flutter kick of an individual.

BACKGROUND OF THE INVENTION

This invention is a new aquatic body propulsion device or swim fin for attachment to the human foot. It is designed for swimmers and swim fin users involved in various surface and underwater swimming sports. Such sports include recreational swimming, competitive swimming, surfing, body-surfing, kick-boarding, body-boarding, knee-boarding, free-diving, snorkeling, skin-diving, scuba-diving and the like.

This new fin is ergonomically designed to take advantage of the natural movements of the torso, legs and feet commonly found in the flutter kick. This enables improved hydrodynamics, propulsion and efficiency. To effectively illustrate the advantages of this new swim fin, the critical yet often overlooked aspects of the flutter kick will be described.

The flutter kick is fundamentally an alternating oscillation involving the legs and feet with a definitive up-stroke and down-stroke. The primary purpose of each sequential "whip-like" stroke is to effectively and efficiently push against the water. This in turn causes a reactive forward propulsion of the body through the water.

Many experts recognize the flutter kick as a crucial counteraction to stabilize the upper torso during the crawl stroke. This kick may involve a sequence of flexion, extension and rotation of various joints from the lumbar vertebrae of the lower back to the flanges of the toes. The specific position of the lower foot for accelerating into the whipping sequence determines the effectiveness and quantity of force generated. The foot position desired is one which provides the widest and flattest surface possible for pushing potential.

The primary movements involved in the flutter kick are anatomical flexion and extension of the hips, knees and ankles. However, many swimmers display styles that incorporate body rotation, hip rotation and medial femoral (upper leg) rotation. Of substantial concern is the ankle and foot undergo motion in a horizontal and oblique plane as well as in the vertical plane. This horizontal movement is limited to inward or medial rotation and commonly referred to as pigeon-toeing, toeing-in or turning-in. The anatomical term is supination, which is defined as inversion and adduction of the ankle and tarsel joints of the foot.

Supination or toeing-in results from the anatomical structure of the ankle and foot. Also, the water pressure against the foot's surface, the relaxation of appropriate muscles and the conscious awareness of the optimal foot position contributes to supination. Swimmers possessing a naturally propelling flutter kick display varying degrees of supination both in the up-stroke and the down-stroke.

During the down-stroke the foot supinates naturally in order to contact more water with the top of the foot. This in turn pushes the water backwards at a more effective angle, as the foot can be extended further in this position. In many cases hyperextension of the lower foot is achieved through supination, thereby adding more pushing power in the downward stroke.

When the anatomical centerline of the foot has angled inwardly during supination, the alignment of the toes changes in reference to the direction of travel of the swimmer. This toe line which can be 65° offset from the anatomical line of the foot, can increase to an approximate 90° angle, perpendicular to the direction of travel.

During the upstroke the foot rotates laterally but stops short of anatomical alignment, thus retaining a degree of supination. Importantly, it should be noted that the angle of supination in both the upward and downward stroke relates directly to the speed and force of the flutter kick. Test results show that the more vigorous the kick the greater the degree of natural supination.

This toe-in or supinated position is observed in the flutter kick of both the crawl stroke (when the swimmer is ventral side down) and the back stroke (when the swimmer is ventral side up). The foot moves into supination only during the leg stroke that moves the foot towards the ventral side of the swimmer. The foot moves away from supination and back towards anatomical alignment during the leg stroke that moves the foot toward the dorsal or back side of the swimmer. Therefore, since the terms upstroke and downstroke can become confusing when speaking of the crawl and back strokes, we will now use the terms ventral and dorsal when examining the flutter kick motion.

Once again defined as inversion and adduction of the lower foot, supination, as applied to a swimmer's foot motion, is somewhat different than foot supination in a standing or weight bearing position. In the flutter kick, a strong emphasis is placed on inversion of the foot and less emphasis on adduction. However, since similar foot muscles control both positions, a significant degree of adduction is usually present. This can be undesirable because it angles or pitches the foot into a position less than optimal for propulsion.

Swimmers with substantial adduction in their supinated foot position, will inwardly rotate the femor or thigh to an appropriate degree that tilts the foot back into a position for optimal push against the water.

Now therefore, there are three significant foot occurrences which compose a *Kenetically Improved Kicking* position in the ventral kick. They are: (1) foot supination; (2) an adjusting and proportionate degree of inward femoral rotation; and (3) foot extension. In the dorsal kick therefore the foot and leg return back to anatomical alignment.

The aforementioned anatomical movements involved in the flutter kick are in general observed and practiced by proficient and competitive participants in the field of swimming and finswimming disciplines. disciplines.

This complete motion of the ventral and dorsal kick can be termed the Kinetically Improved Kicking Cycle or the KIK Cycle. A specific definition of the KIK Cycle is as follows: The complete flutter kick cycle of a leg, including the ventral and dorsal kicks, whereby the foot undergoes changes in position which optimize its alignment for push against the water.

The KIK Cycle will vary among swimmers depending upon foot and ankle flexability, swimming style and experience. This invention specifically addresses supination and the KIK cycle by adapting to and allowing for these natural movements, while increasing performance and comfort.

THE PRIOR ART

There have been many fins of the prior art that have been designed but never directed to the invention herein. In particular, the fin of D.L. Jayet, shown in U.S. Pat. No. 2,865,033, shows a fin having a spread-out orientation but not necessarily offset in the manner provided herein. The fin therein does not account for supination. Furthermore, the offset of the midline is simply shifted. In addition, although the fins can be symmetrical, it is such wherein they would have a difficult time working, inasmuch as the tips very well might be knocked together during the kicking action.

The patent to Decorlieu, namely, U.S. Pat. No. 2,588,363, shows somewhat of an offset. However, it is not tantamount to this invention, nor is it in the configuration as to the symmetry of the swim fin herein for wearing on both feet.

The patent to W. H. Smith, U.S. Des. Pat. No. 132,377 shows somewhat of an offset with a fin. However, this fin and shoe combination cannot be used effectively for swimming.

U.S. Pat. No. 124,013 to Churchill shows a particularly interesting prior art fin. In a top view the Churchill fin is symmetrical whereas its foot pocket has not offset with reference to the rails. It should be kept in mind that the basic design of the Churchill fin is such that hydrodynamic flow favors the direction parallel to the anatomical center line of the foot.

Virtually all swim fins today largely exhibit a standard symmetry as viewed from the top. That is, the medial and lateral sides of the fin follow a similar diverging line in relation to the foot pocket area as shown in the prior art.

One can only assume that the foot pocket to blade parallelism stems from a traditional philosophy that either the foot seldom wavers from an anatomical line during the flutter kick, or that prevention or discouragement of this action will have not ill consequence on power, hydrodynamics or comfort. Supination allows for increased extension, aligning of the foot with the leg in a vertical plane, therefore maximizing hydrodynamics and power. The typical swim fin user when implementing existing or available products must either conform to the hydrodynamic line of the fin and sacrifice supination, or overcome the hydrodynamic line of the fin to achieve supination.

In the first case, the swim fin user must sacrifice maximum extension and hyperextension of the foot. This decreases his angle for an efficient push against the water. In the second case, the swim fin user overcomes the natural hydrodynamic line of the fin to increase extension and push efficiency, but loses the hydrodynamics of the fin and in actuality drags the fin through the water sideways.

A determining factor as to movement in most cases is the overall length and size of the fin. If the fin is relatively small and short the swim fin user has better movement. The swimmer will accept decreased hydrodynamics in the horizontal plane for increased hydrodynamics in the vertical plane. This causes the swimmer to gain a better angle for pushing, by way of increased foot extension.

If the fin is long and cumbersome, it is usually more efficient to kick with no supination. The medial drag is a greater force than a relaxed and natural supination tendency. In such cases the foot cannot extend as far in true anatomical extension. Many swim fin manufacturers, particularly diving fin manufacturers, have attempted to compensate for this by turning the blade of the fin downwardly or rotating the foot pocket upwardly to help align at least the fin blade if not the foot pocket with the leg. This adaptation still discourages supination and leaves the anatomically extended foot in a position of poor hydrodynamic ability.

The basic problems of encouraging the foot to extend without supination while using swim fins are three fold. Firstly, the foot will not extend to its full potential (hyperextension) without a significant degree of supination. Despite attempts to vertically adjust the fin blade the foot and foot pocket still increase drag by not fully aligning with the leg. Secondly, it is uncomfortable for the foot to suspend a large swim blade directly off the end of the foot. This more often than not results in fatigue and cramping of the muscles in the mid-foot or arch area. Thirdly, because of isolated pressure and rubbing on the tops of the second and third toes during the downward stroke, chafing and blistering occur.

This invention solves the problems of the prior art by the fin blade having a medial-lateral symmetry in its top view which runs parallel to the base reference line or direction of travel. In this respect, the outermost position of the fin is typical in general design. However, the innermost portion of the blade is more asymmetrical because of its adaptation to the offset rotated foot pocket. This foot pocket can be offset from a range varying from 15° to 35° in reference to the base line for proper accommodation of the natural and varying degrees of supination of the foot.

The fundamental concept hereof provides for an angular offset of the foot pocket in relationship to the reference line or drive line of the fin to compensate for the average supinated position. This average supinated position is approximately 25° from the reference or base line or direction in which the fin is to be driven to provide the power. The fin can effectively function substantially within the ranges of 15° to 35° from the offset as far as the offset pocket is concerned, as will be seen in the following specification.

The foot pockets of the prior art were all symmetrically rounded at the toe end or squared off. The foot pocket of this invention is angled from the big toe area to the smaller toes to provide for increased comfort. Unlike the prior art, this foot pocket also exhibits a cavity area that tapers or narrows from the inward side of the pocket toward the outward or lateral side of the pocket.

To improve performance, the blade edge of this invention can be asymmetrically curved in a similar direction and pattern to the asymmetrically angled foot pocket end. Therefore, the outermost edge of the blade will exhibit two rounded edges of unequal radial sweep which fair into the side rails of the blade, the lateral or outward side radius being the larger, and the medial or inward side radius being the smaller. This radial relationship can vary in ratio from 1.5 to 1 up to 6 to 1.

With regard to the offset foot pocket, and its axial relationship to the axis of the fin blade, this invention reveals the importance of an axial intersection substantially located within the foot pocket area. This position balances the blade with the foot to prevent stress and twisting of the ankle and lower foot.

SUMMARY OF THE INVENTION

In summation, this invention comprises a symmetrical swim fin which can be used on either foot and has an offset foot pocket in order to provide optimization of the supination of the foot during swimming movements.

The swim fin has a blade portion that extends from a foot pocket. The foot pocket is offset as to the relative midline direction of the swim fin blade. The axis of the swim fin blade intersects the axis of the foot pocket within the foot pocket area.

In particular, the swim fin blade extends from the foot pocket at an angle away from the normal direction of the foot pocket. The blade can terminate in a relatively squared or angularly normal end portion or terminate in an asymmetrically rounded end, whereby the radial relationship of these rounded edges can vary from a ratio of 1.5 to 1 up to 6 to 1.

The foot pocket is provided with an ankle strap molded therewith. The ankle strap is offset from the general line of the foot pocket area in a manner to provide a comfortable movement of the foot within the foot pocket during the supination driving effect of the blade.

The entire foot fin can be molded from elastomeric or plastic material in a number of different types of molding processes to provide for a completed swim fin that has a foot pocket, foot strap, and support rails along the edges thereof. The support rails help to provide resiliency to the entire fin as well as enhancing the overall flow of water from the foot fin as it is being moved through the water.

The foot pocket of this invention narrows or tapers outwardly so as to conform to the thinning of the foot in this same lateral direction. Due to the angle of the end of the foot pocket following the contour of the toes, the fin has substantially improved comfort, fit and functional features. Accordingly, forces applied to the foot by the said fin blade are absorbed by the more lateral side of the foot due to allowed supination, thereby substantially distributing pressure over all five toes evenly, and substantially dismissing stress to the instep area.

BRIEF DESCRIPTION OF THE DRAWINGS

The invention will be more clearly understood by reference to the description below taken in conjunction with the accompanying drawings wherein:

FIG. 16 shows a pair of fins of this invention showing the symmetry thereof on either side whereby the left and right fins are interchangeable with each other, and showing the fin on one side that can be worn on the right foot and the fin on the other side that can be worn on the left foot.

FIG. 17 shows a fin similar to FIG. 1 but turned 180 degrees and incorporates an elongated blade beyond that of the fin shown in FIG. 1.

FIG. 18 shows a fin similar to FIG. 17 with an asymmetrically rounded blade end dotted thereover.

FIG. 19 is a sectional view of the foot fin in the direction of lines 19—19 of FIG. 18 showing the narrowing of the foot pocket toward the outer side of the foot.

FIG. 20 shows a plan view of this invention with a modified asymmetrical blade end with the blade having a relatively long dimension.

FIG. 21 shows a plan view of this invention with a relatively average blade length as shown in FIG. 16 but including the modified blade end portion.

FIG. 22 shows a plan view of a shortened and modified blade end of this invention.

FIG. 25 shows a right foot fin of this invention in a top and bottom plan view, the top view being on the left and the bottom view being on the right, and wherein the invention as shown herein is not interchangeable between the feet inasmuch as there is a separate left and right fin.

FIG. 26 shows a sectional view in the direction of lines 26—26 of FIG. 25, indicating a narrowing or tapering of the foot cavity with a radiused top portion and a relatively flat bottom portion.

DESCRIPTION OF THE PREFERRED EMBODIMENTS

Figure 1:
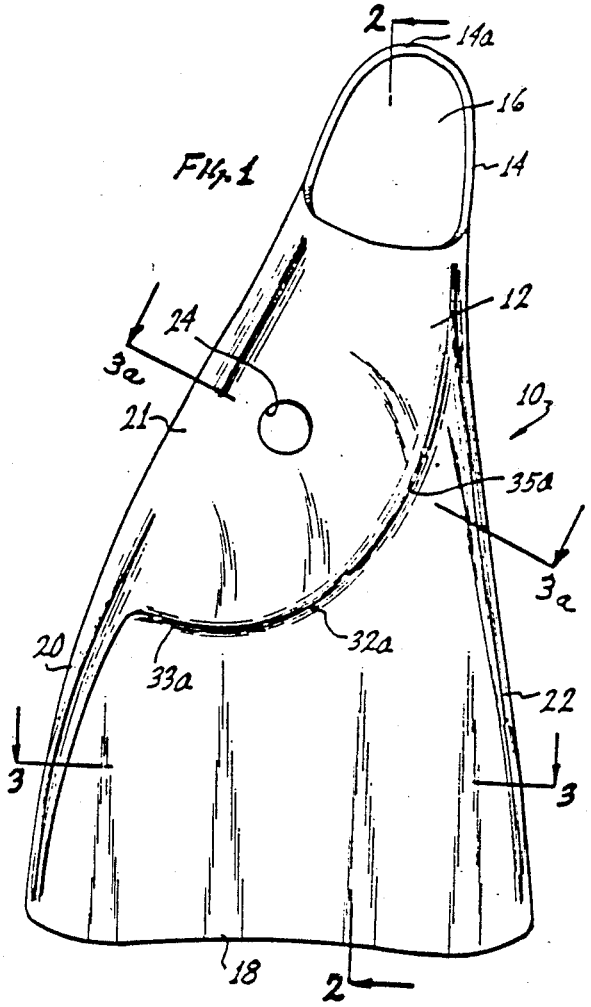
FIG. 1 is a plan view looking downwardly on the foot fin when it is to be used with the left foot.

Looking particularly at FIG. 1, it can be seen that a foot fin 10 of this invention is shown having a bulbous and symmetrical top and bottom foot pocket area 12. An ankle strap 14 is shown with a space 16 therein for receipt of the ankle of the user. A blade portion 18 is shown with a rail on either side. In particular, rails 20 and 22 are shown. Rail 20 extends backwardly toward the foot pocket area 12, while rail 22 extends almost to the point of the ankle opening 16.

A pair of oppositely opposed drainage ports 24 are provided on either side of the fin.

The fin is symmetrical on either side. This can be seen in FIGS. 14 and 17 wherein the same fin turned over so that it can be used on the left and right foot respectively. The showing of FIG. 17 has been turned in such a manner such that the fin is rotated 180° around its axis to show the opposite side of the showing of FIG. 1. Thus, the symmetry of the fin on either side is symmetrical and provides for usage on either foot. This allows the stocking of identical fins for both the left and the right foot.

Figure 2:
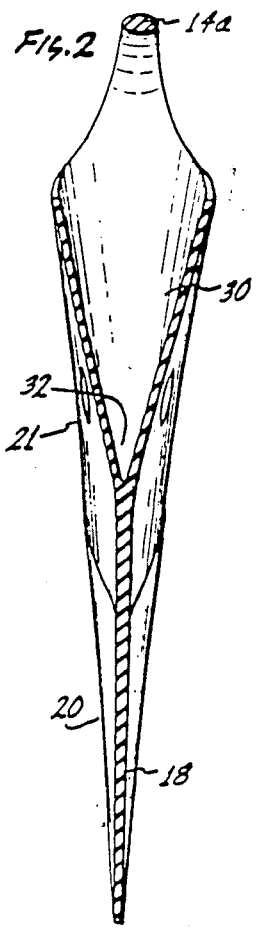
FIG. 2 is a sectional view of the foot fin generally in the direction of lines 2—2 of FIG. 1.

Looking more particularly at FIG. 2, it can be seen wherein the cross sectional view exemplifies the characteristics of the interior of the foot pocket area 12. This showing in the direction of lines 2—2 indicates a foot pocket 30 having a relatively narrow end 32. This allows a stretching of the narrow end 32 of the V-shaped configuration of the foot pocket to receive the toes of the user in a comfortable manner so that they do not chafe and move backwardly and forwardly.

The ankle strap 14 is shown in its sectioned configuration necked down at the end thereof. In particular, the ankle strap of this invention is necked down from approximately 158 inches to ¾ of an inch in thickness. However, these measurements can vary. Although the foregoing dimensions can vary, it exemplified the fact that the ankle strap 14 does neck down to the narrower portion at the end of the strap, detailed as strap portion 14a.

The blade portion 18 can be seen with the rail 20. The rail 20 has been faired upwardly over the foot pocket so as to allow for movement of water over the foot pocket. In particular, the rail 20 is faired in the area 21 to accommodate a smoothly appearing foot fin rail portion 20 fairing into the foot pocket area 12. The rail 20 extends downwardly and upwardly on either side so that the symmetry thereof as seen on the bottom side underlying the blade 18 is exemplified as a continuous rail portion symmetrical on either side of the blade 18.

Figure 3:
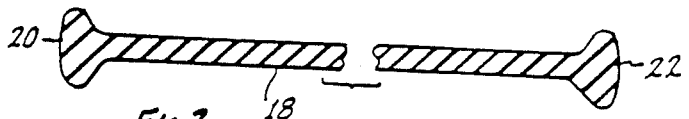
FIG. 3 is a sectional view through the outer portion of the fin showing the enlarged rail portion thereof in the direction of lines 3—3 of FIG. 1.
Figure 3A:
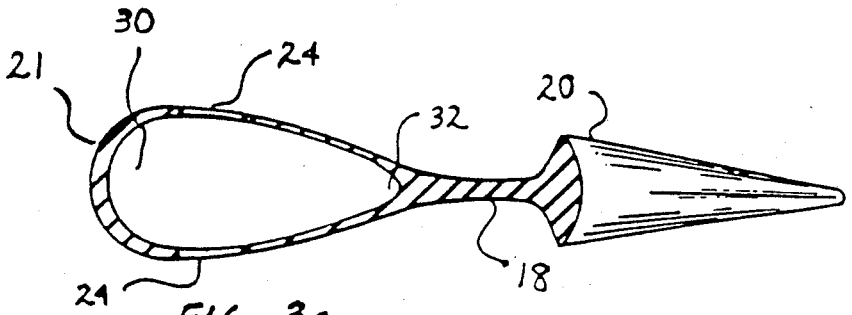
Figure 4:
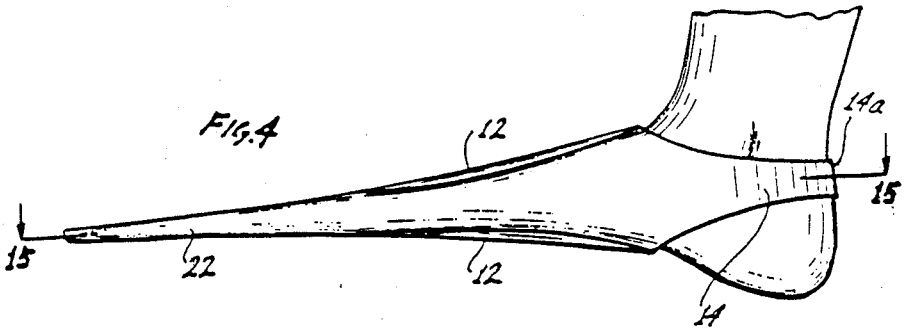
FIG. 4 is a side elevation view of the fin with a foot therein.

The rail portion 22 continues backwardly toward the foot pocket area and the ankle strap as can be exemplified in FIG. 3. This shows the blade 18 in its molded configuration fairing symmetrically into the rail portion 22 on the other side of the foot.

Figure 14:
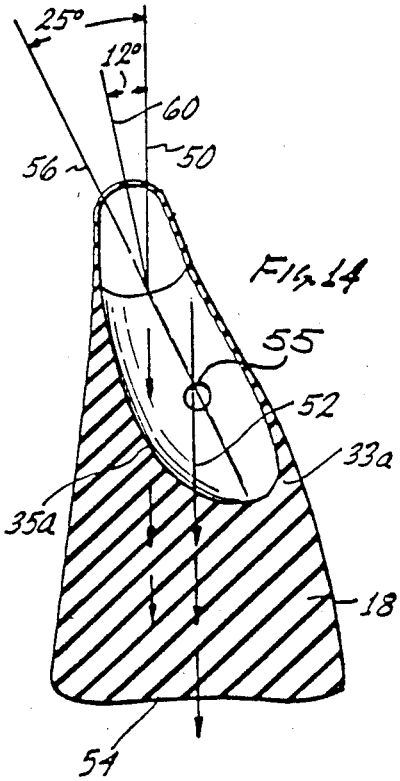
FIG. 14 is a mid line sectional view as shown in the direction of lines 15—15 of FIG. 4.

As can be seen from the showing of FIG. 14, the fin is symmetrical on each side, or what would be the top and bottom, so that it can be used on the left and right foot interchangeably. In particular, the foot pockets 12 shown from the left and right fin that are to be used on the left and right foot respectively are symmetrical. Furthermore, the blade portion is symmetrical on each side. Taken as a whole, the foot fin can be seen as being completely symmetrical on each side and extending toward the end in a rather squared off or angularly normal configuration as to the axis of the fin.

The details of the fin shown in FIGS. 1 and 14 are exemplified also by the opposite view or 180° rotated view in FIG. 17. The blade 18 is shown with the foot pocket area 12, opening 24 or port as well as the ankle strap 14. Additionally, the rail 20 is shown in its rotated position as well as the rail 22.

In order to more fully exemplify the characteristics of the foot fin of this invention, a center line of the main blade or propulsion area of the foot fin is shown as line 52. Line 50 is in parallel relationship to line 52 which also extends in a direction parallel to the axis of the blade or fin in general.

The axial line 50 and 52 are in alignment with an axial line of the fin and extend in a manner so that they can be defined as being generally angularly normal to the end of the blade 18. In particular, the end of the blade 18, namely end 54 is shown being in a substantially perpendicular or squared off relationship in its angular normality to lines 50 and 52. The foot pocket is shown having a line 56 which is the general axial orientation of the foot pocket. It is this axial orientation of the foot pocket as defined by line 56 which can be seen in its offset relationship to the axial lines 50 and 52 of the swim fin.

The offset relationship of the foot pocket area 12 from the direction or axis of the entire fin is exemplified by lines 52 and 54, wherein the foot pocket is offset by 25°. Thus, line 56 which is the general axis of the foot pocket 12 is offset by 25° from the axis of the fin. This offset has been found to be of favorable orientation but is not absolute. It has been found that the fin can be effective when the offset ranges from 12° to 40°. This of course is dependent upon the user and the characteristics of the user's supination. In effect, if the user supinates more or less the offset would be attendantly more or less to accommodate for the supination of a user's foot. However, from a practical point of view, unless the fin is to be custom designed as to each user's degree of supination, the fin should have approximately a 25° offset to accommodate the average supination.

In order to provide for a comfortable foot pocket area of foot pocket 12, the axis of the ankle opening 16 and of course the defining characteristics of the strap 14 therearound is shown with a midline axial orientation line 60. This midline axial orientation line 60 is offset from the axial lines of the foot fin by 12°. In effect, line 60 which is the midline of the ankle opening, is offset 12° from the axial orientation of the fin, namely, that axial orientation which can be defined by lines 50 and 52. Here again, it has been found that the axially oriented and offset ankle strap defining the pocket 16 can be offset to a greater or lesser degree. Thus, it can be offset instead of the 12° by a range of 5° to 20°. The foregoing offset accommodates for the supination of the foot and the drive of the fin when it is in use so that the foot is comfortably held within the space 16 as secured by the ankle strap 14.

Figure 15:
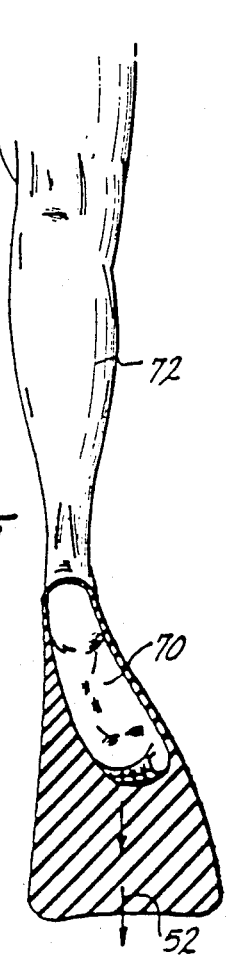
FIG. 15 shows the view of the fin as seen in FIG. 14 as to the sectional view therein with a foot in place detailing the offset supination of the foot.

In order to exemplify the action of a user's foot, FIG. 16 shows the fin orientation shown in FIG. 15 with a user's foot 70 offset to a degree of supination with the user's leg 72. This toeing in or supination of the user's foot 70 is exemplified in the other showings of the various movements of the swimmer as seen in FIGS. 5, 6, 7, 8, 10, 11 and 12.

The axial line 52 is the same general direction as the forward movement of the body and of course axial direction of the leg. The attendant power stroke when kicking can be seen in its offset relationship of the foot 70 or toed-in relationship and is accommodated so that the same axially direct drive in the direction of line 52 is provided. It is this axially directed drive which allows for improved performance so that a greater degree of power can be applied to the foot fin although the foot is in a position of supination.

Figure 5:
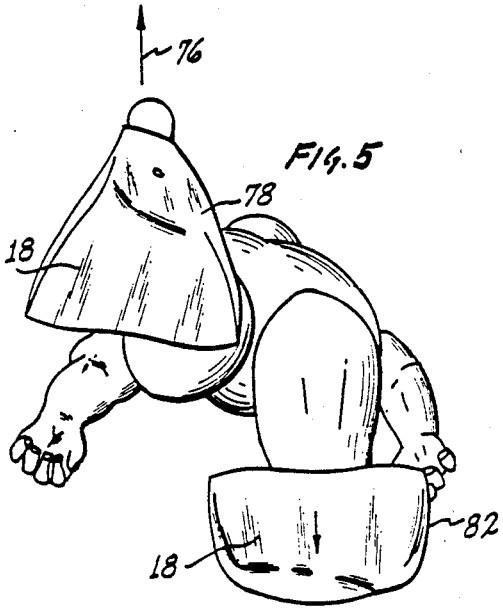
FIG. 5 shows a user with the foot fin in operation emphasizing the direction of propulsion provided by the fin and the general direction of drive.

Looking more particularly at FIG. 5, a like showing of the orientation of the fins as to that shown in FIG. 16 with the inventor's fin hereof is exemplified. FIG. 5 shows the fin 10 moving upwardly in the direction of line 76 as to specific fin 78. The fin is moving downwardly in the direction of line 80 with respect to specific fin 82. Both specific fins 78 and 82 are fins 10 which are symmetrical and worn on the left and right foot respectively. Thus, fin 82 is on the user's right foot and fin 78 is on the user's left foot and comprise the same symmetrical fin 10 in its 180° rotated position.

From the showing of FIG. 5 it can be seen wherein the lines 76 and 80 are directed in the same axial direction as the user's leg in that showing. These lines 76 and 80 are generally the lines which are aligned with the axial lines 50 and 52 of FIG. 15 and power the swimmer in the direction in which the fin can be optimally used rather than in the direction of supination.

Figure 6:
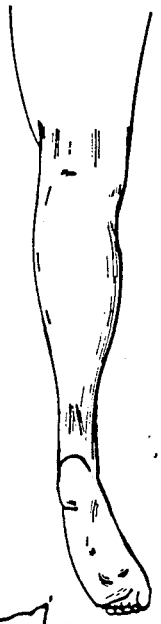
FIG. 6 shows a swimmer's foot looking downwardly at the foot when it is being moved in a supinated manner during a natural swimming movement.

Looking more particularly at FIG. 6, it can be seen wherein the foot is in the position of supination. This supination of the foot would normally not provide as much power with the prior art fin inasmuch as it does not come into as great a degree of contact vectorially with the water. The side view of the foot in its supinated position can be seen in FIG. 11.

If the fin of this invention is not used, a number of circumstances happen within the usage of the prior art fins.

Figure 8:
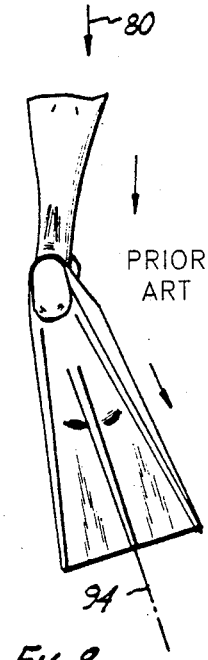
FIG. 8 shows a prior art foot fin that is shown in the offset position due to the supination of the foot during the kicking movement as is seen in FIG. 6.

To exemplify this, FIG. 8 shows a prior art fin which is offset in the same direction as the foot at its angle of supination. In this particular case, the axial line of the prior art fin shown in FIG. 8 which can be seen as axial line 94 is in the same direction as the foot shown in FIG. 6. Thus, a loss of power is encountered due to the fact that vectorial forces are not in the same direction as the direction of the movement of the user or swimmer.

Figure 9:
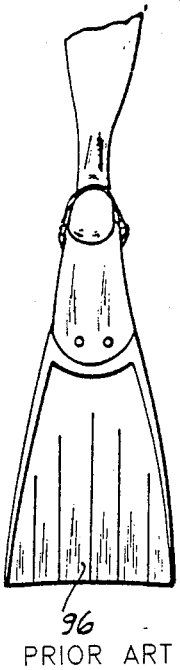
FIG. 9 shows a substantially elongated foot fin of the prior art without supination of the foot.

FIG. 9 shows an extremely elongated fin wherein an axial line 96 is shown. This extremely elongated fin is such that it does not allow for supination, inhibits full extension and therefore causes the foot to drag in a downward manner. This creates an inefficient stroke and a degree of fatigue upon the part of the user.

Figure 10:
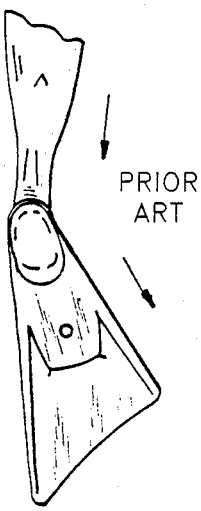
FIG. 10 shows a foot fin of the prior art when the foot is in the supinated position.
Figure 11:
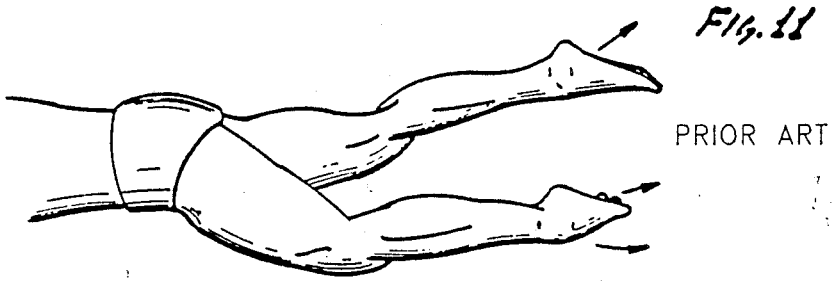
Fig. 11 PRIOR ART
FIG. 11 shows a swimmer naturally kicking in the side view showing supination of the foot in the same manner as is seen in FIG. 6.

Looking at FIG. 10, a prior art fin can be shown wherein the blade has been angled. Here again, there is not a degree of sufficient output of the power stroke of the fin to allow for proper forward movement. The fin has an advantage by virtue of having a larger amount of material on one side than the other. Nevertheless, this larger amount of material is not sufficient to provide any degree of advantage to a user due to the fact that the main thrust of the fin is in an angular offset manner to the desired direction of travel.

Figure 7:
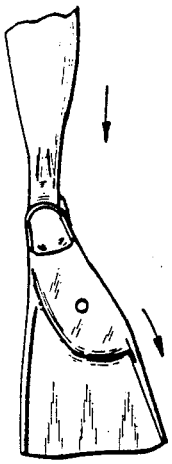
FIG. 7 shows a fin of this invention being driven through the water when the foot is in the supinated position generally shown in FIG. 6.
Figure 12:
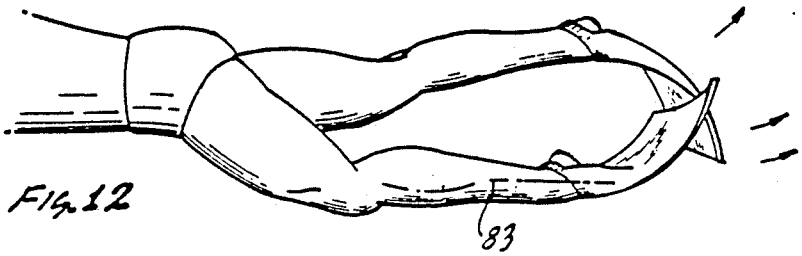
FIG. 12 shows a side view of this invention and generally corresponds to the showing as seen in FIG. 7.
Figure 13:
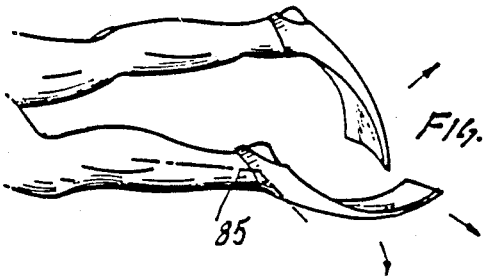
FIG. 13 shows a side view of the enlarged fin shown in FIG. 9.

FIG. 13 exemplifies a side elevation view of the showing of FIG. 9, while FIG. 12 shows the side elevation of the view of the fin of this invention operating in the manner shown in FIGS. 5 and 7. Notice the increased extension of the supinated foot in FIG. 12 as compared to FIG. 13. This is seen by angular reference lines respectively numbered 83 and 85.

As can be seen from the foregoing showings, the drive forces in the direction of the axial lines 50 and 52 are generally maintained even though the foot 70 as shown in FIG. 15 actually supinates. This thereby enhances the overall blade exposure to the direction of movement. Furthermore, with the squared-off blade 54 which is angularly normal to the axial direction of lines 50 and 52 the blade optimizes its overall drive as exemplified by the drive showings of FIGS. 5, 7 and 12. With this in mind, it can be seen that the blade, although the end 54 can be offset, is enhanced by having generally a squared-off end. The blade can be convexedly or interiorly curved as in prior art blades so that it is not substantially squared across the end 54. However, substantial deviations from the direction of lines 50 and 52 as to the normality of the end of blade 18 or the perpendicularity thereof, reduce the overall effectiveness of the lower drive, inasmuch as less surface of the blade 18 is exposed to the driving function. The overall blade may be extended in length for added thrust potential and still remain true to the characteristics herein described. This is shown in FIG. 17 where the blade 18 has been extended by length L.

The end of the foot pocket as seen in FIG. 1 is shown by outline 32*a*. This outline follows from the big toe area at 33*a* to the little toe area at 35*a*. Accordingly, the end of the foot pocket 12 follows the contour of the ends of the toes. This is provided regardless of whether the symmetrical foot pocket is on the left or right foot. Thus, forces applied to the foot by the said fin blade are absorbed by the more lateral side of the foot due to allowed supination, thereby substantially distributing pressure over all five toes evenly, and substantially diminishing stress at the instep area.

The blade end 54 can be modified to improve hydrodynamic flow and increase the moveability of the foot throughout the KIK Cycle by a particular radial ratio at the end of the blade. As shown in FIG. 18, the blade end 54 can be modified to exhibit an asymmetrically rounded end, with two unequal radial sweeps, 102 and 104. The radial distance 112, from axis 116 to circumference line 102, is significantly greater than the distance 114, from axis 118 to circumference 104. The difference between the greater distance 112 and the lesser distance 114, causes a difference between the length of curve 102 and 104. The ratio is about 3.4 to 1 as to the larger radius compared to the smaller radius, respectively 112 and 114. This ratio can be as high as 6 to 1 with respect to the ratio between radius 112 and 114. The significance of this ratio is exemplified in FIGS. 23 and 24 where the left leg of a fin swimmer is shown in the two opposing positions of the KIK Cycle.

Figure 23:
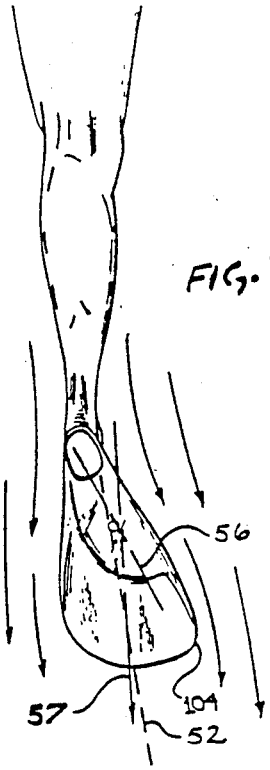
FIG. 23 shows a swimmer's left leg looking downwardly with the use of this invention in a supinated manner, in the ventral kick position.
Figure 24:
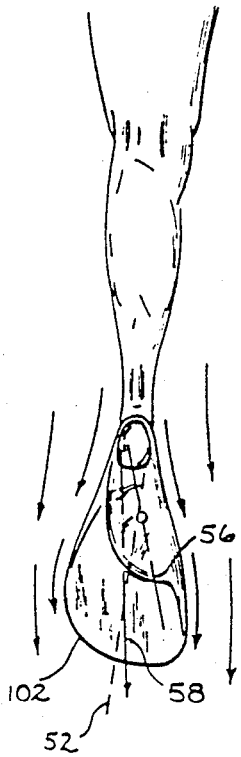
FIG. 24 shows a swimmer's left leg looking downwardly while using this invention in an anatomically aligned position during the dorsal kick.

In FIG. 23 a ventral kick is shown as blade edge 104 serves to stabilize the fin movement into supination and reduce surface drag on the inward side of the blade. In FIG. 24, a dorsal kick is shown as blade edge 102 serves to lead the blade laterally as the foot returns to an anatomically aligned position. A longer radial sweep 102 is needed on this lateral side to enhance the hydrodynamics of the blade, which has much more exposure to water resistance in this outward position. Also, since the origin of rail 22 is located higher on foot pocket 12, radial curve 102 meets rail 22 at a higher point on the blade without disrupting the dynamic functions of said rail.

The foot pocket 12 although angularly asymmetrical in the view of FIG. 18, is quite symmetrical in a sectional view as seen in FIG. 19. The foot pocket cavity 30 narrows in a lateral manner to the outward portion 32. The distance 34 from center line 31 to the top of the foot pocket 12, is three times greater than the distance 36 from the center line 31 to the top of the foot pocket 12 when measured equally from either end of line 31. This ratio conforms to the average foot contour. To the extent of any significant narrowing, ratios from 1.5 to 1 up to 4 to 1 are effective to provide an appropriate foot pocket contour.

This same tapered feature is viewed in an asymmetrical manner in FIG. 26. Here, area 124 is considerably larger than area 125. The asymmetrical aspects overly the flattened surface area 126 at the bottom of the foot pocket to accommodate the contour of the foot.

An asymmetrically rounded blade end described in and dotted in FIG. 18 is effective in encouraging the natural KIK Cycle in several different blade lengths as seen in FIGS. 20, 21 and 22. As the blade length changes, the position between curved edges 102 and 104 and the corresponding rails 20 and 22 is altered. FIG. 20 shows an adaptive curve 101 between rail portion 22 and curve 102. An adaptive curve 103 joins curve 102 with curve 104. An adaptive curve 105 joins curve 104 with rail 20. The length of these adaptive curves can be substantially altered by changing the blade length, as noticed in FIGS. 20, 21 and 22.

Notice in FIGS. 20 through 22, the axis of the fin blade intersects the axis of the foot pocket within the foot pocket area. Contrary to the prior art which shows an insignificant offset with an axial intersection substantially outside or beyond the foot area, this invention is intended to balance the blade with the drive force of the foot in a manner which promotes superior comfort, power and aligned leverage.

Blade length, in relation to this invention has a direct effect on the performance features of the fin with regard to the KIK Cycle. As the blade is lengthened, the degree of offset is reduced, due to its inhibiting affect on the foot's ability to supinate. Also, because of the adaptive design of the blade to the foot pocket, the axial intersection point 55 will rise significantly up the axial line of the foot pocket 56, as shown in FIG. 20. As the blade is shortened, the degree of offset can increase up to the functional average offset of the uninhibited KIK Cycle.

Keeping in mind the significant and workable range of offset, that being 12° to 40°, the axial intersection 55 will be higher on the foot pocket axis 56 with an offset of 12°, and lower on the foot pocket axis 56 with an offset of 40°. The exact location of the axial intersection 55 at any given offset within the foot pocket, will depend on the overall contour of the fin as a whole.

The symmetrical nature of this invention, as shown in FIG. 16, has manufacturing, distribution, retail and consumer advantages. However, the basic principles of this design can be incorporated into a nonsymmetrical fin, whereby a separate left and right fin are provided and cannot be interchanged. FIG. 25 exemplifies this by showing several asymmetrical properties. In this showing, the foot pocket 121 is raised above the blade substantially to hold the foot in a manner as sectionally shown in FIG. 26.

The outline 129 of the foot pocket, as shown in FIG. 25, is seen only on the top side of the fin, whereas the underside would remain relatively flat as viewed by fin side 122.

The underside foot opening 128 recesses beyond the top side opening, and a vent port 123 can be present on one side only. Rail portion 127 can fair higher on this modification, and be raised substantially into the foot pocket as shown in FIG. 26.

The ankle strap 14 can be formed as an adjustable strap with or without a buckle or bale and adjustable for length in any suitable manner. Also, the blade can be seated or formed for flow through the vent as in prior fins referred to as a Rocket or Jet Fin as patented by Beauchat.

As can be seen from the foregoing, this invention is a substantial step over the prior art in reorienting the foot pocket and blade portions of a swim fin as well as the strap portion to provide optimum driving by one's legs in a symmetrical fin that can be interchanged between the left and right foot. As a consequence, it should be read broadly in light of the prior art when considering the following claims.

I claim:

1. A swim fin formed with a foot pocket and a blade wherein the improvement comprises:

an offset within the range of 12° to 40° of said foot pocket angularly from the centerline axis of said blade in a direction to cause the offset to compensate for the supination of the foot during a swimmer's flutter kick and place the axis of the blade in the general direction of a swimmer's leg during a flutter kick motion.

2. The swim fin as claimed in claim 1 further comprising:

rail portions of a greater cross sectional thickness at the edge regions of said blade for providing resiliency and strength to said blade.

3. The swim fin as claimed in 1 further comprising:

an ankle strap for securing said swim fin to a user's ankle having an axis which is offset from the axis of said foot pocket within the range of 5° to 20°.

4. The swim fin as claimed in claim 1 wherein:

said swim fin is symmetrical on the top and bottom thereof so as to allow the swim fin to be interchanged between the left and right foot.

5. A swim fin formed with a foot pocket and a blade comprising:

an ankle strap for securing said swim fin to a user's ankle having an centerline axis which is offset from the centerline axis of said foot pocket in the direction of supination of a swimmer's foot during use within the range of 5° to 20°.

6. The swim fin as claimed in claim 5 wherein:

said swim fin is symmetrical as to form on either side thereof so as to allow the swim fin to be interchanged between the left and the right foot.

7. A swim fin adapted for interchangeable utilization between the left and the right foot comprising:

a foot pocket section formed from an elastomeric material and having an ankle strap connected thereto that is formed in a manner so that the top and bottom thereof are interchangeable respectively between the left and right foot and wherein the top and bottom is substantially symmetrical to effectuate the interchange between the left and right foot;

a blade extending from said foot pocket formed as an elongated blade therefrom which is substantially symmetrical on the top and bottom thereof so that when said respective foot pocket and said blade are turned in either direction on the major surfaces thereof, the fin can be used respectively on the left or the right foot; and wherein, a foot pocket is angularly offset from the axis of said blade portion within the range of 12° to 40°.

8. The fin as claimed in claim 7 further comprising:

rails on the edge regions of said fin which are substantially symmetrical on either side of said blade and which extend from said foot pocket toward the end of said blade in a diminishing manner.

9. The fin as claimed in claim 7 further comprising:

at least one port within said foot pocket.

10. The fin as claimed in claim 7 further comprising:

an ankle strap connected to said foot pocket which is offset as to its axis within the range of 5° to 20° from the axis of said foot pocket.

11. A swim fin wherein the improvement comprises:

a fin formed with a foot pocket which receives a foot therein; and, a blade extending from said foot pocket that is at an offset angle of 12° to 40° in the direction to compensate for a swimmer's supinated movement so that the supinated angular position of the swimmer's foot when toed in allows for the blade portion to be directed in its axial direction in substantially the same direction as a user's leg and body.

12. The swim fin as claimed in claim 11 wherein:

said fin has a symmetrical foot pocket on its top and bottom so that it can be interchanged with the left or right foot.

13. The swim fin as claimed in claim 11 further comprising:

rail portions extending from said foot pocket in the direction of the end of said blade to reinforce and provide resiliency to said fin.

14. The swim fin as claimed in claim 11 further comprising:

an ankle strap connected to said foot pocket which is angularly offset form the axis of said foot pocket within the range of 5° to 20°.

15. The swim fin as claimed in claim 11 wherein:

said blade portion end is substantially at a right angle to the axis of said blade portion.

16. The swim fin as claimed in claim 11 wherein:

said blade portion end is asymmetrically curved so that one side has a greater radius than the other side.

17. The swim fin as claimed in claim 16 wherein:

said blade portion end radii are in a ratio range of 1.5 to 1, to 6 to 1.

18. A swim fin formed with a foot pocket and a blade wherein the improvement comprises:

a foot pocket having a tapered portion tapering laterally from the inner portion of a user's foot to the outer portion between the end of the toe portion and the opening of the foot pocket in order to accommodate for the size of the foot narrowing from the inside to the outside.

19. The swim fin as claimed in claim 18 further comprising:

an offset of said foot pocket angularly from the axis of said blade in a direction to cause the offset to compensate for the supination of the foot during a swimmer's flutter kick to place the axis of the blade in a general direction of a swimmer's leg during a flutter kick motion, wherein the offset is within the range of 12° to 40°.

20. The swim fin as claimed in claim 18 further comprising:

an ankle strap for securing said swim fin to a user's ankle having an axis which is offset from the axis of said foot pocket within the range of 5° to 20°.

21. The swim fin as claimed in claim 18 wherein:

said swim fin is symmetrical on the top and bottom thereof so as to allow the swim fin to be interchanged between the left and the right foot.

22. A swim fin formed with a foot pocket and a blade wherein the improvement comprises:

an offset of said foot pocket angularly from the axis of said blade in a direction to cause the offset to compensate for the supination of the foot during a swimmer's flutter kick and place the axis of the blade in the general direction of a swimmer's leg during a flutter kick motion wherein the intersection of the axis of the foot pocket and the axis of the blade is within the foot pocket.

23. The swim fin as claimed in claim 22 wherein:

the offset is within the range of 12° to 40°.

24. The swim fin as claimed in claim 22 wherein:

said swim fin is symmetrical on the top and bottom thereof so as to allow the fin to be interchanged between the left and right foot.

25. The swim fin as claimed in claim 22 further comprising:

a curved end of said blade wherein the curve on the inside of the user's foot has a radius smaller than the curve on the outside of the user's foot wherein this ratio of the inside curve to the ratio of the curve on the outside is within the range of 1 to 1.5 to 1 to 6.

26. A swim fin formed with a foot pocket and a unitary blade wherein the improvement comprises:

a one piece continuous blade extending from the foot pocket to the fin tip having curved ends on the inside and outside portions formed substantially continuously between both ends with a respective radius of the inside portion within the range of a ratio to the outside portion of 1.0 to 1.5 to 1.0 to 6.

27. The swim fin as claimed in claim 26 further comprising:

an offset of said foot pocket angularly from the axis of said blade in a direction to cause the offset to compensate for the supination of a foot during a swimmer's flutter kick to place the axis of the blade in the general direction of a swimmer's leg during a flutter kick motion.

28. The swim fin as claimed in claim 25 further comprising:

an ankle strap for securing said swim fin to a user's ankle having an axis which is offset from the axis of said foot pocket within the range of 5° to 20°.

29. The swim fin as claimed in claim 26 further comprising bottom thereof so as to allow the swim fin to be interchanged between the left and the right foot.

* * * * *